United States Patent [19]

Braddick

[11] Patent Number: 4,562,889

[45] Date of Patent: Jan. 7, 1986

[54] METHOD AND APPARATUS FOR ROTATING AND RECIPROCATING WELL BORE LINER

[76] Inventor: Britt O. Braddick, P.O. Box 35729, Houston, Tex. 77235

[21] Appl. No.: 600,108

[22] Filed: Apr. 13, 1984

[51] Int. Cl.[4] ..... E21B 19/00

[52] U.S. Cl. ..... 166/381; 166/208; 166/217

[58] Field of Search ..... 166/381, 382, 206, 208, 166/216, 217

[56] References Cited

U.S. PATENT DOCUMENTS 3,223,170 12/1965 Mott ..... 166/208

4,060,131 11/1977 Kenneday et al. ..... 166/382

*Primary Examiner*—Stephen J. Novosad

*Assistant Examiner*—William P. Neuder

*Attorney, Agent, or Firm*—Jack W. Hayden

[57] ABSTRACT

Method and apparatus for supporting a liner so that the work string which lowers the liner into a well can be manipulated to selectively rotate and/or reciprocate the liner before hanging it on a casing in a well bore and for rotating the liner after it is hung on the casing.

11 Claims, 10 Drawing Figures

METHOD AND APPARATUS FOR ROTATING AND RECIPROCATING WELL BORE LINER

BACKGROUND OF THE INVENTION

1. Field of the Invention

The field of the invention relates to rotating and reciprocating a liner in a well to condition the well for cementing operations and to rotating the liner after the work string is threadedly disconnected from the liner and the liner hung in the well.

2. Description of the Prior Art and Summary of the Invention

Devices for selectively rotating and/or reciprocating a liner in a well bore to condition the well bore before cementing operations and before the liner is hung on a casing in the well bore are well known and have long been in use.

However, in some situations it is desirable to rotate the liner after it is hung or suspended by hanger means in a casing in a well bore, and after the work string has been disconnected therefrom. Heretofore, no device has been provided which would satisfactorily accomplish this result. In conducting well bore cementing operations, it is most desirable, if not necessary, to disconnect the well string or work string from the liner setting arrangement before cementing operations are begun. This avoids the possibility of cementing the well string in the well bore if something unusual or unexpected occurs during the cementing operation which prevents the well string from being properly disengaged from the liner hanger setting mechanism.

However, the present invention overcomes this problem in that the work string comprising the drill string or any suitable well string may be used to lower the present invention into the well bore with a liner supported thereon, and the liner can be rotated in the well bore as well as reciprocated before it is hung on the casing so as to condition the hole in a desired and well known manner. Thereafter, the well string is disconnected from the liner and liner hanger setting arrangement so that the well string can be retrieved in the event of an emergency; however, the present invention is constructed and arranged so that after the liner has been hung and after the drill string, or work string, has been disconnected from the liner and liner hanger setting arrangement, the work string may thereafter be manipulated to impart rotation to the hung liner. Further, rotation of the liner may be effected as cementing operations are performed and in the event of an emergency, the work string can be removed merely by elevating, or raising, it since the work string is not mechanically locked or interconnected with the liner hanging arrangement.

Other objects and advantages of the present invention will become apparent from a consideration of the following description and drawings:

DESCRIPTION OF THE PREFERRED EMBODIMENTS

Figure 1:
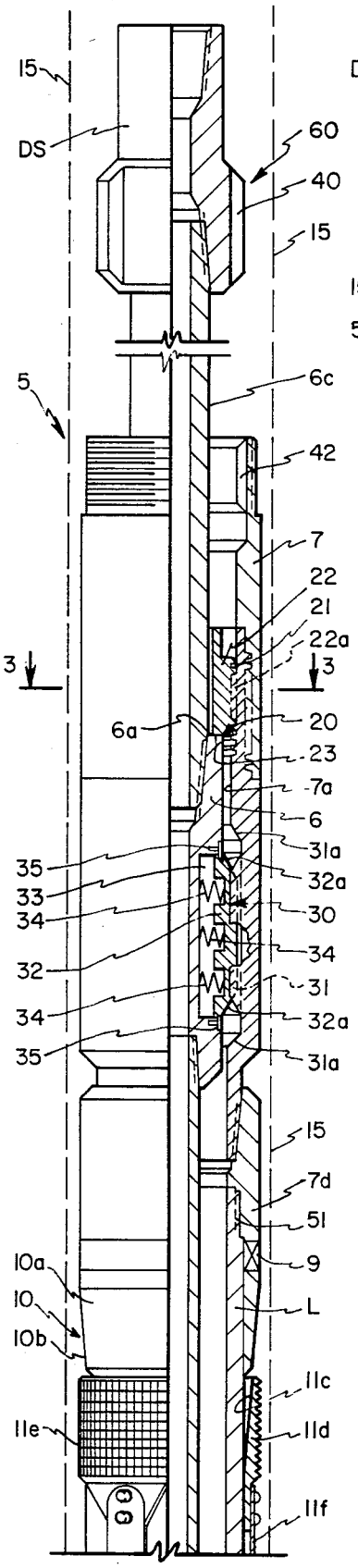
FIG. 1 is a quarter sectional view illustrating one embodiment of the present invention.

Attention is first directed to FIG. 1 wherein the present invention is referred to generally by the numeral 5. It includes inner and outer members 6 and 7 which are telescopically arranged as illustrated in the drawings. The outer member has a liner L secured therewith and depending therefrom to extend through bearing means 9 and liner hanger 10 supported on the outer member 7 as shown. The construction and arrangement of the bearing means 9 and liner hanger arrangement 10 is well known in the art.

It should be noted that in connection with the present invention a liner hanger arrangement 10 which is mechanically actuated is shown and the invention will be described in relation thereto; however, a hydraulic liner hanging setting arrangement may be employed, and the mechanical liner hanging arrangement 10 illustrated in the drawings is for purposes of illustration only and not by way of limitation. The liner hanger arrangement, whether it be mechanical or hydraulic, is employed for hanging the liner L on the casing represented in dotted line at 15. It will be noted that the liner hanger arrangement referred to generally at 10 in FIG. 1 includes the conical member 10*a* having the downwardly tapered surface 10*b* for receiving the surface 11*c* of the slips 11*d* whereby the serrated surface 11*e* of the slips 11*d* is urged outwardly into securing position with the inner surface of the casing which is diagrammatically represented at 15.

The mechanical liner hanger arrangement 10 illustrated in the drawings is manipulated in a manner well known to those skilled in the art to effect engagement of the liner hanger arrangement 10 with the casing 15. A releasable connection in the form of a J slot (not shown) is carried by the lower portion of the members 11*f* with which the slips 11*d* are secured, and by raising the drill string DS and the invention 5 supported thereon, the J slot configuration unlocks upon slight rotation of the drill string DS. Bow springs forming part of the members 11*f* (not shown) restrain the members 11*f* and slips 11*d* against rotation as rotation of the drill string DS is effected to unlock the J slot arrangement. Thereafter, when the drill string DS and arrangement 5 are lowered, the cone 10*a* is telescoped into the slip segments 11*d* and they in turn are expanded into engagement with the casing 15.

However, it is generally desired to reciprocate and rotate the liner L in the well bore before the liner L is hung on the casing 15. Means are provided on the inner and outer members 6, 7 to reciprocate the liner L by manipulating the work string DS, such means referred to generally by the number 20 in the form shown in FIG. 1 and the form shown in FIG. 2. Similarly, means to rotate the liner by manipulating the work string before the liner is set are provided on the inner and outer members 6 and 7, such means being referred to generally by the numeral 30 in FIG. 1 and FIG. 2.

Figure 2:
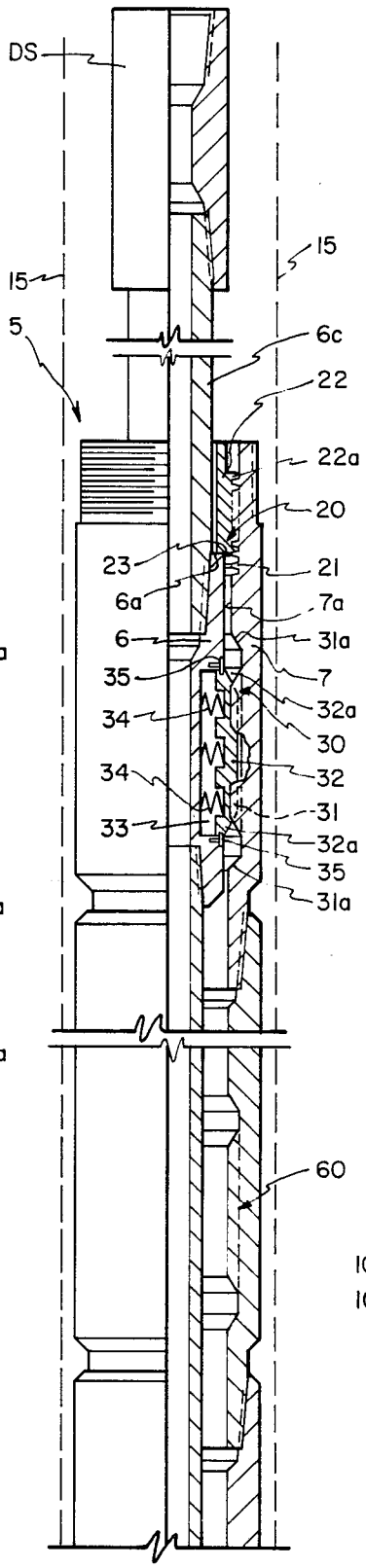
FIG. 2 is a quarter sectional view illustrating another embodiment of the present invention.
Figure 2A:
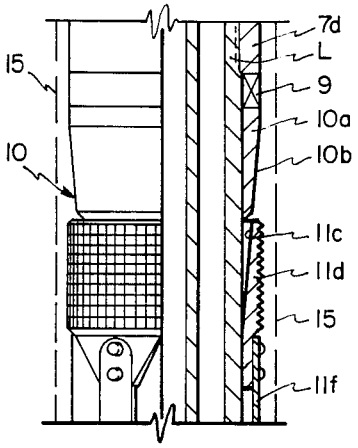
FIG. 2A is a quarter sectional view and is a continuation of the lower end of FIG. 2.
Figure 3:
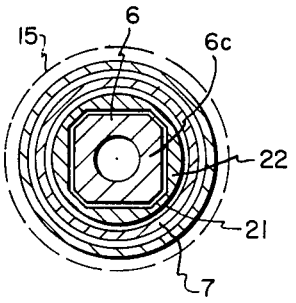
FIG. 3 is a sectional view on the line 3—3 of FIG. 1 to better illustrate a noncircular mandrel connected with the work string and forming the upper end of the inner body 6.

The means to reciprocate also functions to initially support the outer member 7 on the inner member 6 and includes a left-hand thread means or surface 21 formed on the internal bore 7*a* of the member 7 as shown in FIGS. 1 and 2. A disengaging nut 22 is provided with left-hand threads on its external periphery 22*a* for loosely, threadedly engaging with the lefthand threaded surface or threaded means 21 on outer member 7. The lower end of the nut 22 provides an annular downwardly facing surface or shoulder 23 which abuts the upwardly annular facing surface or shoulder 6*a* on the inner member 6 formed adjacent its connection with the noncircular mandrel 6*c* threadedly secure therewith and extending upwardly therefrom to be threadedly engaged with the drill string DS as shown in FIGS. 1 and 2 of the drawings.

The foregoing arrangement not only provides a means to support the outer member 7, liner hanger arrangement 10 and liner L on the inner member 6, but provides an arrangement for enabling the drill string DS to reciprocate and rotate the present invention 5 and liner L in the well bore prior to hanging the liner L on the casing 15. Such arrangement further enables the inner member 6 and connected work string DS to be disconnected from the outer member 7 and liner L after it is hung by the liner hanging arrangement 10 on the casing 15 as will be described.

The means to rotate the inner and outer members to effect rotation of the liner L before hanging the liner on the casing includes longitudinal slots 31 circumferentially spaced and formed in the outer member 7 as shown in FIGS. 1 and 2. Longitudinal spring biased key means 32 are arranged in longitudinally extending slots 33 formed on the inner member 6, and are urged outwardly by suitable spring means such as at 34 between the bottom of the slots 33 and bottom of keys 32.

Keeper means 35 are secured in any suitable fashion to the inner member 6 adjacent the edges of the circumferentially spaced slots 33 and overlap the edges of the slots 33 as well as a portion of the longitudinal keys 32 to prevent ejection of the longitudinal keys 32 from the slot means 33. It will be noted that the ends 31*a* of the slot means are tapered as shown. Similarly, the ends 32*a* of the longitudinal keys 32 are tapered so that when the inner member 6 is moved longitudinally relative to the outer member 7, the longitudinal keys 32 may engage the sloping surfaces 31*a* which compresses the springs 34 to assist in moving the keys 32 into and out of the slots 33.

Figure 6A:
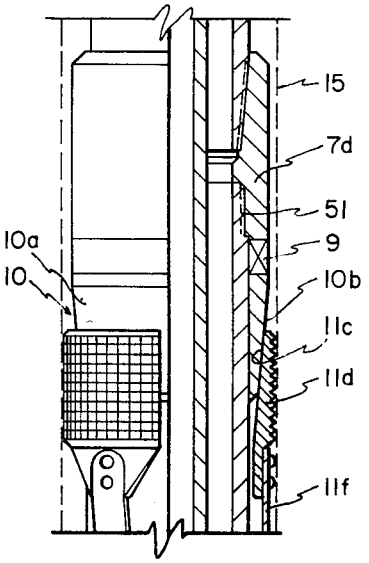
FIG. 6A is a quarter sectional view showing the lower portion of the FIGS. 1 and 2 embodiments with the liner suspended in the casing.

The disconnection of the inner member 6 and outer member 7 in the FIG. 1 and FIG. 2 form is accomplished after the liner hanger arrangement 10 has been manipulated so that the slips 11*e* are expanded into engagement with the casing 15 by riding up on the tapered surface 10*b* of the liner hanging arrangement 10 in a manner as previously described and as shown in FIG. 6A. After the liner L has been hung on the casing 15, the means to rotate and means to reciprocate the inner outer bodies 6 and 7 may be disengaged by lowering the work string DS and inner member 6 downwardly relative to outer member 7 to disengage the shoulders 6*a* and 23.

Figure 4:
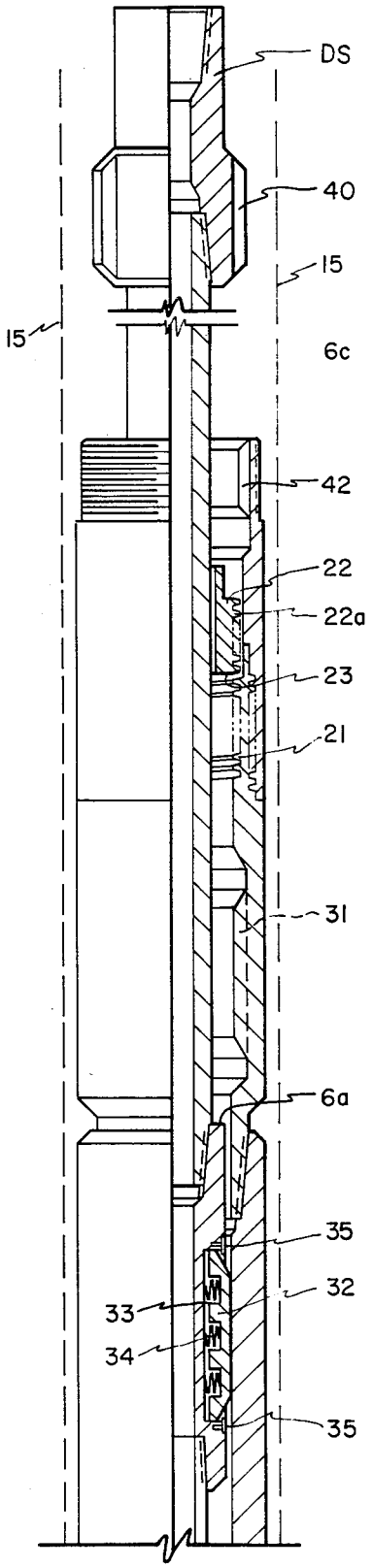
FIG. 4 illustrates the position of the components of the FIG. 1 embodiment after the work string is disconnected from the outer member forming part of the liner hanger arrangement and after the liner is suspended in the casing.
Figure 5:
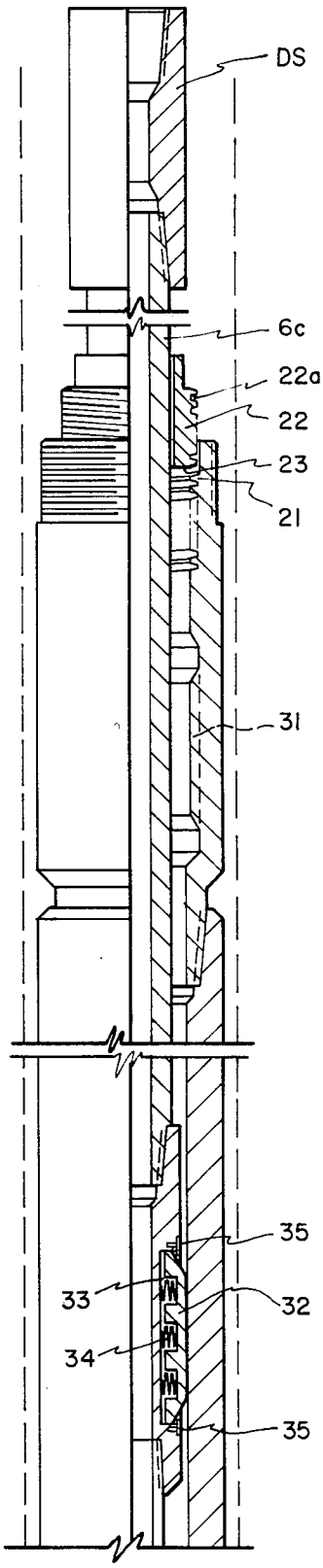
FIG. 5 shows the position of the FIG. 2 components after the work string is disconnected from the outer member forming part of the liner hanger arrangement and after the liner is suspended in the casing.
Figure 6:
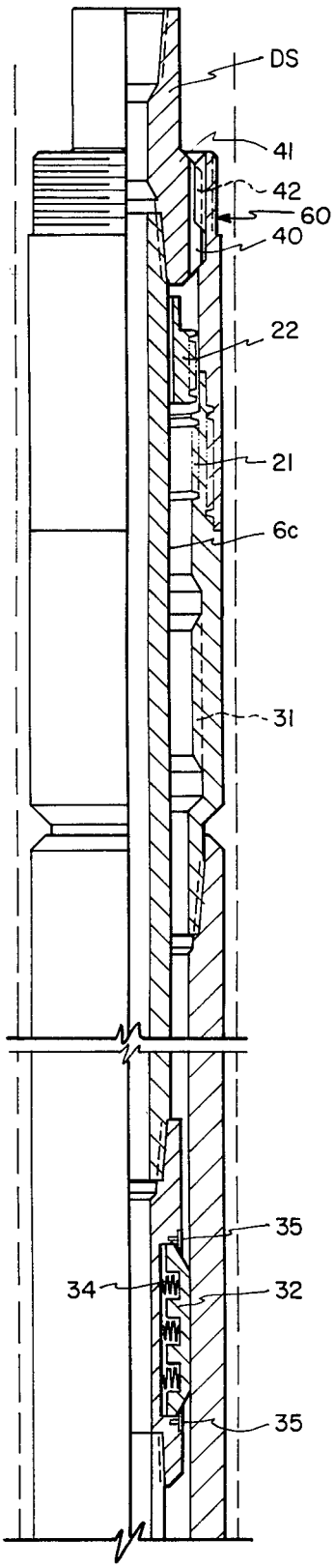
FIG. 6 is a quarter sectional view showing the work string of the FIG. 1 embodiment lowered to releasably contacting the outer member for rotation of the liner after the work string is disconnected therefrom.

After the inner member 6 has been moved or lowered a sufficient amount so that the keys 32 are completely moved out of the slots 31 in the outer member 7, the disengaging nut 22 is disengaged from the threaded surface means 21 of the outer member 7 by right-hand rotation of the drill string DS. Since the mandrel 6*c* is noncircular, rotation of the inner member 6 is imparted to the disengaging nut 22. The outer member 7 is restrained against rotation sufficiently by the liner L hung on the casing 15 and by the bow springs previously mentioned so that it will remain stationary relative to the rotation of the inner member 6 by the drill string or work string DS. This causes the nut 22 to unthread from left-hand thread 21 and move up as shown in FIGS. 4, 5 and 6. Rotation is continued until the loosely threaded disengaging nut 22 is completely disengaged from the left-hand threaded means or portion 21 on the outer member 7. This disconnects or disengages inner member 6 from outer member 7.

Figure 8:
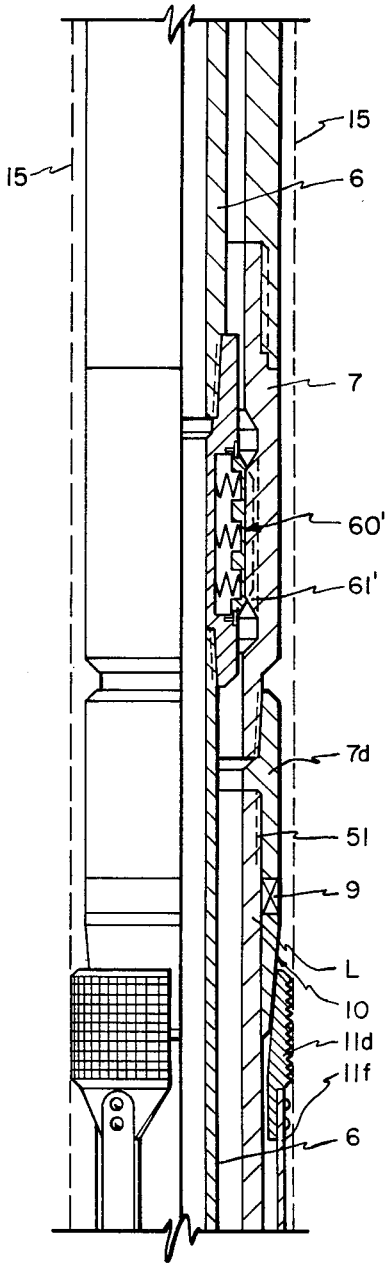
FIG. 8 is a continuation of the view shown in FIG. 7 and showing the relationship of certain components during liner rotation after it is hung.

Thereafter, the drill string DS, in the embodiment illustrated in FIG. 1, may be lowered relative to outer member 7 which is now supported on casing 15 along with liner L. The lowering of the drill string DS is continued until the additional means 60 on the inner and outer members 6 and 7 releasably contact so that rotation may be imparted to liner L after it is hung. The additional means 60 as better seen in in FIG. 6 includes circumferentially spaced projections 40 formed on the drive head 41 on the lower end of the drill string DS to contact in the longitudinal slots 42 formed in the upper end of the outer member 7 as shown in FIG. 6. The longitudinal slots 42 are circumferentially spaced to receive the splines or projections 40 on the drive head 41. When the splines 41 have been releasably contacted within the longitudinal grooves 42 of the outer member 7, rotation may be imparted to the outer member 7 and the liner L secured therewith by rotating the work string DS. The bearing means 9 on the outer member 7 is secured therewith in a manner well known in the art. The rotatable bearing means 9 is between the hanger arrangement 10 and the coupling 7*d* at the lower end of the outer member 7 as shown in FIGS. 1, 2A, 6A and 8 of the drawings. The liner L is threaded as shown at 51 to the coupling member 7*d* and extends downwardly through the bearing means 9 and the hanger arrangement 10 as shown in FIGS. 1, 2A, 6A and 8. This enables the liner L to be rotated relative to bearing 9 and liner hanger arrangement 10 which supports liner L on casing 15 as shown in FIGS. 6A and 8 when the drill string DS is rotated.

Since the disengaging nut 22 has been disengaged from lefthand thread 21, the outer member 7 and liner L are released from the inner member 6 and work string DS and are supported in the casing 15 by means of the liner hanger arrangement 10 as shown in FIGS. 6A and 8.

Therefore, in the form shown in FIGS. 1, 4 and 6 when the work string DS is moved downwardly to engage the splines 40 with the grooves 42, rotation may be imparted to the outer member 7 and liner L, and the only connection between the work string DS and the outer member 7 and hanger arrangement 10 is by reason of the drive arrangement including the releasably contacted inner fitting splines 40 and grooves 42. This enables the drill string DS and the inner member 6 to be disengaged, or released, from the liner L in the event of an emergency merely by pulling up on the drill string DS. As the outer member 7 is rotated by the work string DS, rotation is likewise imparted to the liner L since the bearing means 9 accommodates rotation of the outer member 7 and the supported liner L relative to the rotatable bearing means 9 and the hanger arrangement 10.

The rotation and reciprocation of the liner L before hanging and rotation of the liner L after hanging is accomplished in the FIGS. 2, 5, 7 and 8 form in the same general manner, but with some slight modification of structure.

Figure 7:
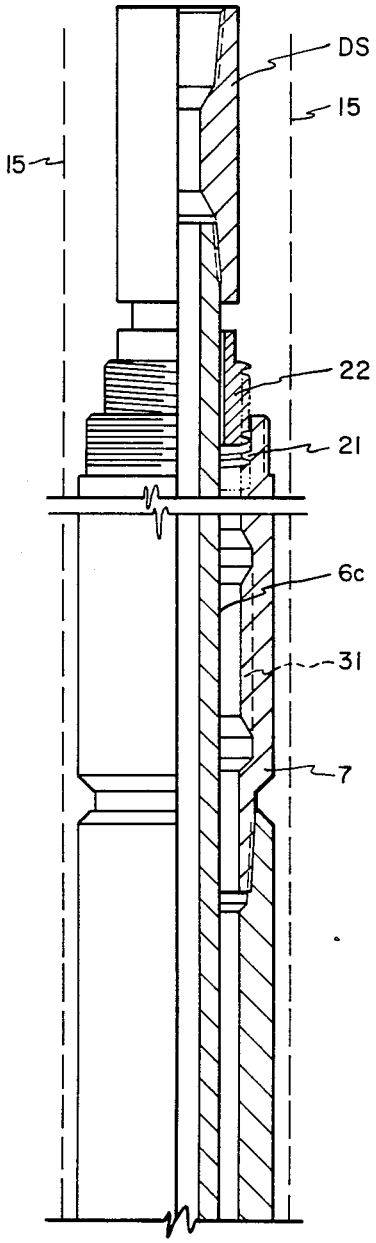
FIG. 7 is a quarter sectional view of the upper part of the FIG. 2 embodiment showing the work string releasably contacting the outer member for rotation of the liner after the work string is disconnected therefrom.

In the FIGS. 2, 5, 7 and 8 form, it will be noted that the outer member 7 has a bearing means 9 mounted thereon and a hanger arrangement 10 including the cone member 10*a* and slips 11*d* as in the FIG. 1 form. Rotation and reciprocation of the liner L before hanging the liner L on the casing 15 is accomplished in the same manner as the FIG. 1 form. The liner L is again threadedly connected at 51 to the outer member 7 above the bearing means 9 as shown in FIGS. 7 and 8 and rotation and reciprocation of liner L is accomplished by raising and lowering the work string DS in a manner to that described with regard to the FIG. 1 modification. It will be noted that the disengaging nut 22 is provided with a threaded exterior 22*a* for threadedly engaging with the left-hand thread 21 at the upper inner end in the bore 7*a* of the outer member 7 as described with regard to the FIG. 1 modification.

After the desired amount of hole conditioning has been accomplished by rotating and reciprocating the liner L by raising and lowering and rotating the drill string DS, the liner hanger 10 is set on the casing 15 by manipulating the work string DS to disengage the J slot arrangement (not shown) so that the slip segments 11*d* may be engaged on the conical member 10*a* by further manipulating the drill string DS as above described.

In the FIG. 2 form after the liner L has been hung in the casing 15, the inner member 6 and drill string DS connected therewith may be disengaged from the outer member 7 by lowering the work string to disengage the longitudinal spring biased keys 32 carried on the inner member 6 from the longitudinal slots 31 in the outer member 7. When the work string DS has been lowered sufficiently so that the longitudinal keys 32 are completely out of the slot means 31 in the outer member 7, the drill string DS is rotated which causes the noncircular mandrel 6*c* to unthread the disengaging nut 22 from the threaded portion 22*a* as previously described.

After the disengaging nut 22 has been disengaged, continued lowering of the work string DS, relative to member 7 and liner L which is now hung on casing 15 as shown in FIG. 8, aligns the inner member 6 and outer member 7 so that they may be releasably contacted by additional means 60' as shown in FIG. 8 provided for enabling the liner L which has now been hung in the casing 15 by the hanger arrangement 10 to be rotated. The additional means 60' of the FIG. 2 form includes additional longitudinal slots 61' in the outer member 7 which are longitudinally spaced below the upper longitudinal slots 31 as shown. They are of a similar configuration and arrangement and are of a size to receive the longitudinal, spring biased keys 32 therein carried on inner member 6. When the spring biased keys 32 have been lowered with member 6 so that they are positioned in alignment with the longitudinal grooves 61' in the outer member 7, the longitudinal keys 32 and longitudinal groove 61' intercontact to enable rotation to be imparted to the liner L after it has been hung in the well bore as shown in FIG. 8.

It should be noted, however, that disengagement of the work string DS and inner member 6 from the outer member 7 and hung liner L is readily effected by merely raising or elevating the work string DS so as to shift the keys 32 longitudinally and out of the circumferentially spaced grooves 61' in the outer member 7.

This provides an arrangement for accomplishing the desired rotation of the liner L after it has been hung in the well bore and after it has been disconnected from the work string so that desired rotation of the liner L may be accomplished on the one hand without maintaining the work string mechanically connected thereto in a manner which might outerwise cause problems in the event of some malfunction during cementing operations. This reduces, if not completely eliminates, the possibility of cementing the drill string DS in the well bore which might occur during some malfunction, yet enables rotation of the liner to be readily effected after it has been set.

From the foregoing description, it can be appreciated that the present invention enables a liner to be lowered on a work string in a well bore and to be rotated and reciprocated to condition the hole as desired before the hanger is set or hung on casing in the well bore. Thereafter, in those situations where it is desired to rotate the casing after hanging and before or during cementing operations while substantially eliminating the risk of cementing the drill string in the well bore if a malfunction occurs, the keys 32 may be engaged in the additional longitudinally spaced grooves 61' in the outer member 7 by lowering inner member 6 whereby such rotation can be effected yet while permitting quick release should a problem arise.

In both the FIGS. 1 and 2 forms, the outer member 7 is carried on inner member 6 by surface 6*a* which abuts surface 23 on the nut 22 threadedly engaged with outer member 7. This enables the arrangement to be lowered into the well bore and reciprocated as desired for hole conditioning. Also, slots 31 on outer member 7 and keys 32 on inner member 6 enable both the FIGS. 1 and 2 forms to be rotated in the well bore before the liner L is hung on casing 15.

After the liner L is hung on casing 15, the inner and outer members of the FIGS. 1 and 2 forms are disconnected in the same manner, that is, by rotation of the drill string DS and noncircular mandrel 6 to unthread nut 22 from threaded surface 21 on outer member 7. When the nut 22 is completely unthreaded, inner and outer members may be manipulated to impart rotation to the liner L which has now been hung on casing 15.

In the FIG. 1 form, this is accomplished by lowering inner member 6 so splines 41 engage in grooves 42 of inner member 7 and rotation of liner L is then effected by rotating drill string DS and inner member 6 connected therewith. In both the FIGS. 1 and 2 forms, lowering of memer 6 relative to member 7 also disconnects the keys 32 from slots 31 so that the preferred quick release contact arrangement of the FIGS. 1 and 2 form then may be employed to rotate the hung liner L. As seen in the drawings, the keys 32 and slots 31 are spaced longitudinally below the nut 22.

In the FIG. 2 form, additional slots 61' are spaced below the slots 31 and lowering of member 6 will move the keys 32 whereby they may engage in slots 61' so that rotation of members 6 by the drill string rotates the hung liner L as cementing operations are conducted. If necessary, the drill string may be quickly released from outer member 7 and liner L merely by pulling up on the drill string, as in the FIG. 1 arrangement.

As previously noted, the present invention has been shown and described in detail as it relates to a mechanical liner hanger arrangement 10. However, a hydraulic liner hanger arrangement may also be employed to accomplish setting or hanging the liner L on the well bore without effecting the operation of the present invention.

The foregoing disclosure and description of the invention are illustrative and explanatory thereof, and various changes in the size, shape and materials as well as in the details of the illustrated construction may be made without departing from the spirit of the invention.

What is claimed is:

1. In an arrangement for supporting on a work string to rotate and reciprocate a liner before setting it by hanger means on a casing in a well bore and for rotating the liner after it is set on the casing wherein an outer member has a liner secured thereto, with hanger means supported on the outer member for hanging the liner on the casing and bearing means on the outer member to accommodate rotation between the outer member and liner relative to the casing and hanger means, and wherein an inner member is telescopically received in the outer member, the inner member having a noncircular mandrel connected with the work string, the invention including:

means on the inner and outer members to reciprocate and rotate the liner by manipulating the work string before the liner is set on the casing, said means to rotate being disengageable upon relative longitudinal movement between the inner and outer members after the liner has been hung;

means supporting the outer member and liner on the inner member, said means including left-hand thread means on the outer member and disengaging nut means threadedly secured on said thread means and telescopically receiving the mandrel whereby rotation of the work string after the liner is hung on the casing disconnects said disengaging nut from said thread means and disconnects the outer member from the inner member and work string; and additional means on the inner and outer member engageable after the inner and outer members are disconnected from each other to rotate the outer member and liner relative to the hanger means and casing upon rotating the work string.

2. The invention of claim 1 wherein said additional means includes interfitting groove and spline means formed adjacent the upper end of the outer member and the lower end of the work string, respectively.

3. The invention of claim 1 wherein said additional means includes longitudinal slot means in the outer member and spring biased longitudinal key means on the inner member for engaging in said slot means upon lowering the work string.

4. The invention of claim 1 wherein said means to reciprocate before setting the liner includes shoulder means on said disengaging nut means and abutting shoulder means on the inner member.

5. The invention of claim 1 wherein said means to rotate before setting the liner includes longitudinal slot means in the outer member and spring biased longitudinal key means on the inner member engaged in said slot means.

6. The invention of claim 5 wherein said spring biased longitudinal key means include:

longitudinal slots in the outer member;

longitudinal key means for fitting in the longitudinal slots;

spring means in the slots abutting said key means to urge them outwardly of the slots; and keeper means on said inner body and overlapping said longitudinal keys to limit their outward movement and prevent their ejection from the longitudinal slots.

7. An arrangement for supporting on a work string to rotate and reciprocate a liner before setting it by hanger means on a casing in a well bore and for rotating the liner after it is set on the casing comprising:

inner and outer telescopically arranged members, said outer member having:

1. a liner secured thereto;
2. hanger means supported thereon; and
3. bearing means to accommodate rotation of said outer member and liner relative to the casing and hanger means;

said inner member having a noncircular mandrel connected with the work string;

means supporting the outer member and liner on the inner member, said means including:

1. left-hand thread means on the outer member; and
2. disengaging nut means threadedly secured on said thread means and telescopically receiving said mandrel whereby rotation of the work string disconnects said disengaging nut means from said thread means and releases the outer member from the inner member and work string;

means on the inner and outer members to reciprocate and rotate the liner by manipulating the work string before the liner is set on the casing;

said means to reciprocate before setting the liner including shoulder means on said disengaging nut means and abutting shoulder means on the inner member whereby the liner may be reciprocated in the well bore by raising and lowering the work string;

said means to rotate before setting the liner including first longitudinal slot means in the outer member and spring biased longitudinal key means on the inner member engaged in said slot means whereby the liner may be rotated by rotating the well string;

additional means on the inner and outer members releasably engageable after the inner and outer member are released from each other to rotate the outer member and liner relative to the hanger means and casing upon rotating the work string, said additional means including second longitudinal slot means in the outer member spaced longitudinally from said first slot means and engageable with said spring biased longitudinal key means on the inner member when the work string is manipulated to align said key means on the inner member with said second slot means.

8. An arrangement for supporting on a work string to rotate and reciprocate a liner before setting it by hanger means on a casing in a well bore and for rotating the liner after it is set on the casing comprising:

inner and outer telescopically arranged members, said outer member having:

1. a liner secured thereto;
2. the hanger mean supported thereon; and
3. bearing means to accommodate rotation of said outer member and liner relative to the casing and hanger means;

said inner member having a noncircular mandrel connected with the work string;

means supporting the outer member and liner on the inner member, said means including:

1. left-hand thread means on the outer member; and
2. disengaging nut means threadedly secured on said thread means and telescopically receiving said mandrel whereby rotation of the work string disconnects said disengaging nut means from said thread means and releases the outer member from the inner member and work string;

means on the inner and outer members to reciprocate and rotate the liner by manipulating the work string before the liner is set on the casing;

said means to reciprocate before setting the liner including shoulder means on said disengaging nut means and abutting shoulder means on the inner member whereby the liner may be reciprocated in the well bore by raising and lowering the work string;

said means to rotate before setting the liner including longitudinal slot means in the outer member and spring biased longitudinal key means on the inner member engaged in said slot means whereby the liner may be rotated by rotating the well string;

additional means on the inner and outer members engageable after the inner and outer members and released from each other to rotate the outer member and liner relative to the hanger means and casing upon rotating the work string, said additional means including interfitting groove and spline means formed adjacent the upper end of the outer member and the lower end of the work string respectively.

9. An arrangement for supporting on a work string to rotate and reciprocate a liner before setting it by hanger means on a casing in a well bore and for rotating the liner after it is set on the casing comprising:

inner and outer telescopically arranged members, said outer member having:

1. a liner secured thereto;
2. hanger means supported thereon; and
3. bearing means to accommodate rotation of said outer member and liner relative to the casing and hanger means;

said inner member having a noncircular mandrel connected with the work string;

means supporting the outer member and liner on the inner member, said means including:

1. left-hand thread means on the outer member; and
2. disengaging nut means threadedly secured on said thread means and telescopically receiving said mandrel whereby rotation of the work string disconnects said disengaging nut means from said thread means and releases the outer member from the inner member and work string;

means on the inner and outer members to reciprocate and rotate the liner by manipulating the work string before the liner is set on the casing;

said means to reciprocate before setting the liner including shoulder means on said disengaging nut means and abutting shoulder means on the inner member whereby the liner may be reciprocated in the well bore by raising and lowering the work string;

said means to rotate before setting the liner including longitudinal slot means in the outer member and spring biased longitudinal key means on the inner member engaged in said slot means whereby the liner may be rotated by rotating the well string;

additional means on the inner and outer members releasably engageable after the inner and outer member are released from each other to rotate the outer member and liner relative to the hanger means and casing upon rotating the work string.

10. A method of rotating and reciprocating a liner rotatably supported on a member that is releasably secured to a well string for lowering into a well bore having a casing comprising the steps of:

lowering the member and the liner into the well bore;

selectively raising and/or lowering and rotating the well string to selectively reciprocate and/or rotate the liner in the well bore to condition the well bore;

manipulating the well string to disconnect it from the member and liner and to suspend the liner in the well bore casing; and lowering the well string to contact the member and rotating the well string to rotate the suspended liner.

11. In an arrangement for supporting on a work string to selectively rotate and/or reciprocate a liner before setting it on a casing in a well bore and for rotating the liner after it is set on the casing wherein an outer member has a liner secured thereto and bearing means on the outer member to accommodate rotation between the outer member and liner relative to the casing and wherein an inner member is telescopically received in the outer member, the invention including:

means supporting the outer member and liner on the inner member;

means on the inner and outer members to selectively rotate and/or reciprocate the liner by manipulating the work string before the liner is set on the casing; and additional means on the inner and outer members to rotate the outer member and liner after the liner is set on the casing.

* * * * *

Adverse Decision in Interference

In Interference No. 101,694, involving Patent No. 4,562,889, B. O. Braddick, METHOD AND APPARATUS FOR ROTATING AND RECIPROCATING WELL BORE LINER, final judgment adverse to the patentee was rendered January 31, 1990, as to claims 1-11.

*[Official Gazette August 28, 1990]*